US009863154B2

(12) United States Patent
Messick, Jr. et al.

(10) Patent No.: US 9,863,154 B2
(45) Date of Patent: Jan. 9, 2018

(54) SIMULATED MOIRE ARCHITECTURAL MESH PANEL

(71) Applicant: Cambridge International Inc., Cambridge, MD (US)

(72) Inventors: George H. Messick, Jr., Cambridge, MD (US); Thomas O. Perdue, Salisbury, MD (US); Matthew C. O'Connell, Cambridge, MD (US); Jeffrey D. Ulchak, Salisbury, MD (US); Robert E. Maine, Jr., Salisbury, MD (US)

(73) Assignee: CAMBRIDGE INTERNATIONAL INC., Cambridge, MD (US)

( * ) Notice: Subject to any disclaimer, the term of this patent is extended or adjusted under 35 U.S.C. 154(b) by 0 days.

(21) Appl. No.: 15/062,820

(22) Filed: Mar. 7, 2016

(65) Prior Publication Data

US 2016/0258184 A1 Sep. 8, 2016

Related U.S. Application Data

(60) Provisional application No. 62/129,312, filed on Mar. 6, 2015.

(51) Int. Cl.

| | |
|---|---|
| ***E04H 17/04*** | (2006.01) |
| ***E04F 13/08*** | (2006.01) |
| *E04H 17/08* | (2006.01) |

(52) U.S. Cl.

CPC ..... *E04F 13/0871* (2013.01)

(58) Field of Classification Search

CPC ..... E04F 13/0871
USPC ..... 52/676
See application file for complete search history.

(56) References Cited

U.S. PATENT DOCUMENTS

| | | | | |
|---|---|---|---|---|
| 3,672,187 A * | 6/1972 | Simpson | D04B 21/14 | 66/192 |
| 3,962,510 A * | 6/1976 | Worcester | B32B 27/12 | 139/426 R |
| 4,144,727 A * | 3/1979 | Duhl | D04H 1/52 | 66/190 |
| 4,277,527 A * | 7/1981 | Duhl | B32B 5/08 | 428/109 |
| 4,520,636 A * | 6/1985 | Schnegg | D04B 21/06 | 66/192 |

(Continued)

*Primary Examiner* — Charles A Fox
*Assistant Examiner* — Joseph J Sadlon
(74) *Attorney, Agent, or Firm* — Buchanan Ingersoll & Rooney PC

(57) ABSTRACT

An architectural mesh panel includes a plurality of spaced rods and a plurality of adjacent rows of pickets, each of the rows of pickets including at least a plurality of first links, a plurality of second links and a plurality of third links, the plurality of first links have a first spacing, the plurality of second links have a second spacing, and the plurality of third links have a third spacing, wherein each of the rows of pickets includes at least two adjacent first links defining a closely spaced link area, wherein each of the rows of pickets includes at least one second link disposed adjacent the closely spaced link area on each side thereof, wherein the closely spaced link area creates a simulated moiré appearance of a moving stripe to an observer whose viewpoint is continuously changing from one side of the architectural mesh panel towards the other.

12 Claims, 13 Drawing Sheets

(56) References Cited

U.S. PATENT DOCUMENTS

| | | | | | |
|---|---|---|---|---|---|
| 4,642,960 | A * | 2/1987 | Wallover, III | E04B 2/8605 | 52/385 |
| 4,724,179 | A * | 2/1988 | Schnegg | D04B 23/10 | 156/78 |
| 4,744,189 | A * | 5/1988 | Wilson | B44C 1/28 | 40/908 |
| 5,763,043 | A * | 6/1998 | Porter | D03D 9/00 | 428/109 |
| 5,851,200 | A * | 12/1998 | Higashikawa | A61M 5/284 | 604/111 |
| 6,017,830 | A * | 1/2000 | Brown | B44C 5/04 | 428/141 |
| 6,226,945 | B1 * | 5/2001 | Henry | E04B 7/00 | 52/3 |
| 6,429,153 | B1 * | 8/2002 | Welkers | B01D 39/083 | 405/302.7 |
| 7,160,600 | B2 * | 1/2007 | Shepard | A44B 18/0011 | 24/442 |
| 8,608,883 | B2 * | 12/2013 | Blasdel | E02D 31/02 | 156/242 |
| 2016/0258183 | A1 * | 9/2016 | Masserant | E04H 17/04 | |

* cited by examiner

SIMULATED MOIRE ARCHITECTURAL MESH PANEL

TECHNICAL FIELD

The disclosure herein relates to an architectural mesh panel, and more particularly, to an architectural mesh panel which simulates the look of a moiré pattern.

BACKGROUND

A moiré pattern is a secondary pattern created when two primary patterns (sometimes identical) are overlaid on a flat or curved surface while displacing them either linearly or rotationally one from another. That is, an independent pattern seen by an observer when two geometrically regular patterns (as two sets of parallel lines or two halftone screens) are superimposed. This pattern 10, 20 can be naturally evident or can be considered a form of an optical illusion, as shown in FIGS. 1A and 1B.

Moiré patterns can also be three dimensional if there is a depth displacement between the two primary patterns. This not only results in the creation of a new secondary optical pattern (or illusion), but it can also make the pattern change—appear as if it is moving, if the viewpoint of the observer is moving in relation to the fixed locations of the primary patterns.

Flexible metal mesh is widely used in cladding systems for buildings because it is aesthetically pleasing, provides security/safety, is easier to install than fixed panels and it can adapt simply to curved or angled building surfaces.

There are existing moiré building schemes that typically include an overlaid pattern system or a twisted element system. The overlaid pattern system uses two primary patterns, usually two or more cable groups or fixed panels that are displaced linearly or rotationally. Further, the cable groups can also be varied in depth from one another to further increase the effect. As shown in FIG. 2, the overlaid pattern 30 includes vertical and linear displaced cable groups having a varying depth to provide an aesthetical design in the building cladding system.

The twisted element system does not provide as strong of a secondary pattern as the overlaid pattern system, but is able to achieve a similar effect with one primary pattern and a contrasting background due to the depth created via the twisted elements. The more depth the elements have the stronger the moiré effect. However, the higher depth creates more wind load on the building and it requires more structural members/anchor points to absorb these forces.

While these systems are both successful at creating the desired effects for the building cladding they are difficult to install, expensive and are not easily adaptable to irregular building surfaces. The expense is partly due to the installation costs associated with the systems but also because of the need for either two primary patterns or heavy anchor systems to create the effect. The moiré effect is of interest in building cladding systems because it can give the appearance that the surface of the building is moving when a viewer is walking or driving by the location during the day or night, if properly lit.

Accordingly, it would be desirable to provide an easy to install inexpensive moiré-like architectural mesh system that can create variable patterns for building exteriors and interiors as well.

SUMMARY

The disclosure herein provides an architectural mesh panel including a plurality of spaced rods and a plurality of adjacent rows of pickets, each of the rows of pickets including at least a plurality of first links, a plurality of second links and a plurality of third links, the plurality of first links have a first spacing, the plurality of second links have a second spacing, and the plurality of third links have a third spacing, wherein each of the rows of pickets includes at least two adjacent first links defining a closely spaced link area, wherein each of the rows of pickets includes at least one second link disposed adjacent the closely spaced link area on each side thereof, wherein the closely spaced link area creates a simulated moiré appearance of a moving stripe to an observer whose viewpoint is continuously changing from one side of the architectural mesh panel towards the other.

BRIEF DESCRIPTION OF THE FIGURES

These and other features and advantages of the disclosure will become more readily apparent to those skilled in the art upon reading the following detailed description, in conjunction with the appended drawings in which.

DETAILED DESCRIPTION OF THE PREFERRED EMBODIMENTS

Figure 1A:
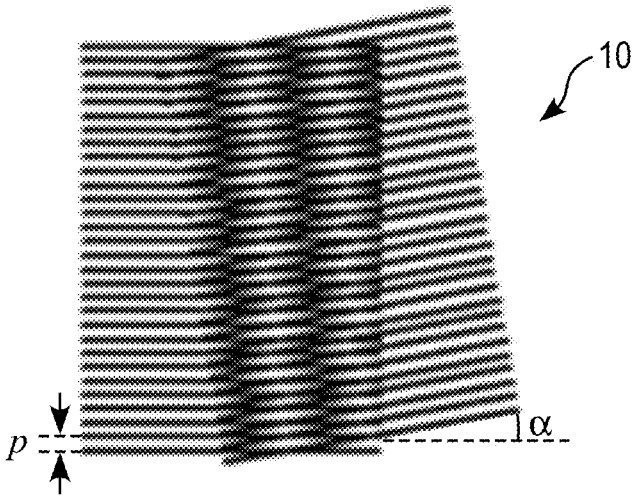
PRIOR ART FIG. 1A
FIGS. 1A and 1B are examples of a moiré pattern created from two overlaid patterns.
Figure 1B:
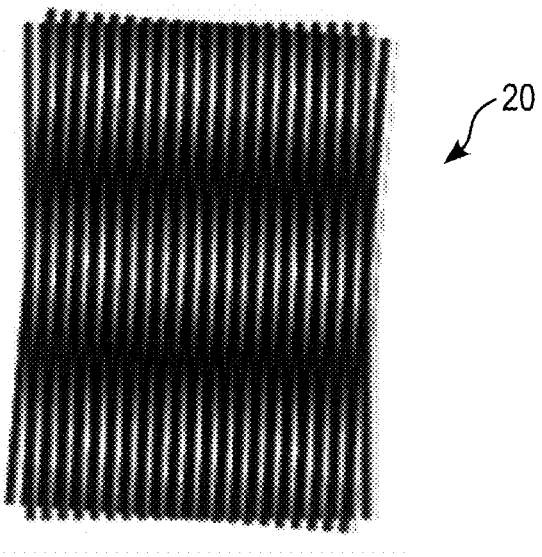
PRIOR ART FIG. 1B
Figure 2:
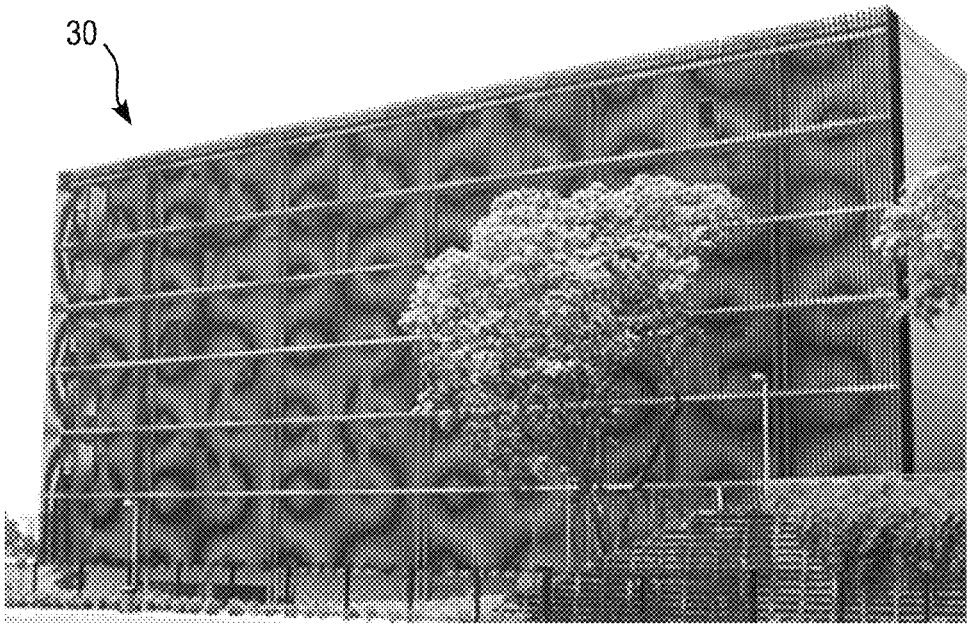
PRIOR ART FIG. 2
FIG. 2 is a front view of a moiré pattern created from two overlaid patterns when applied to a building.
Figure 3:
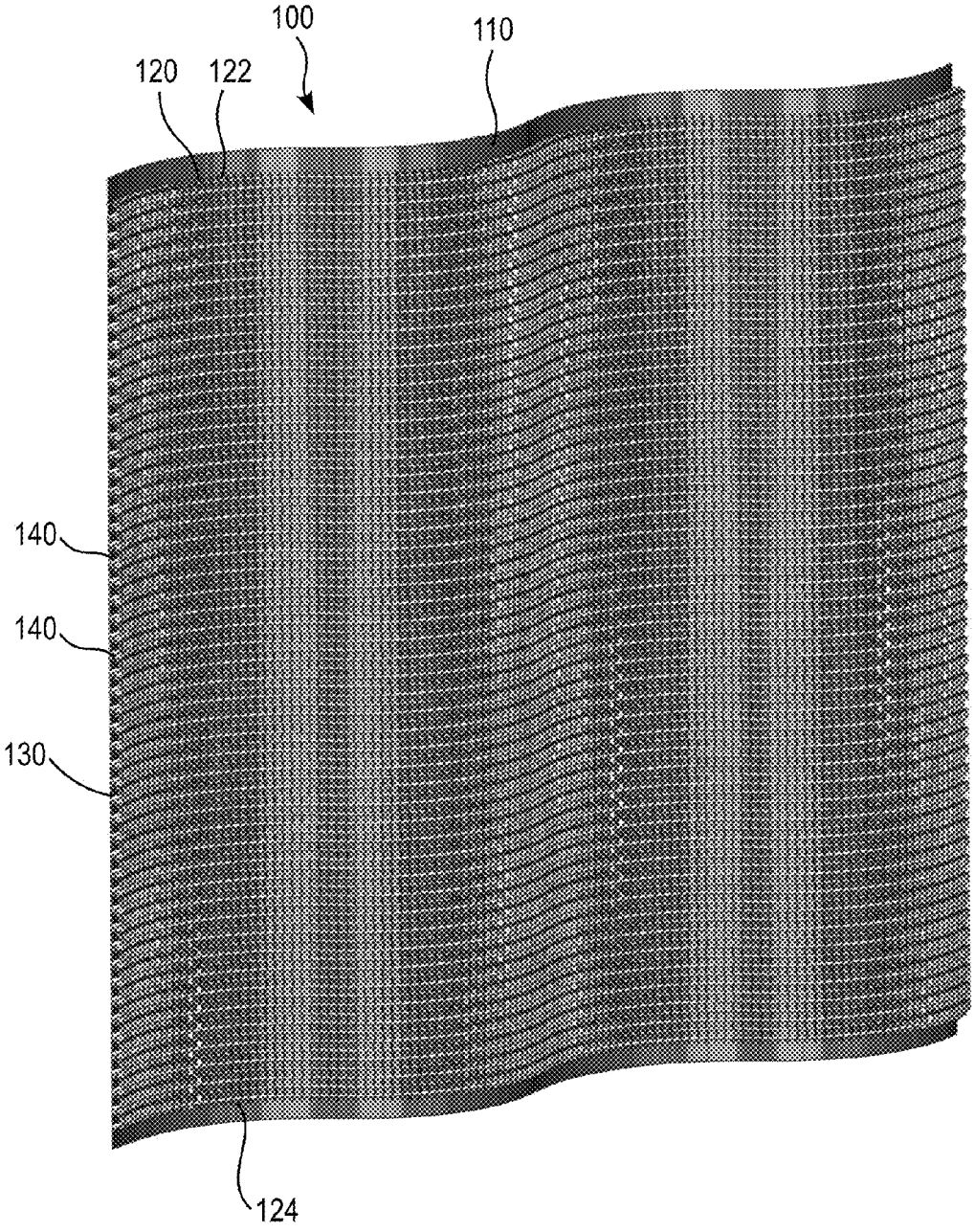
FIG. 3 is a perspective view of an exemplary embodiment of a simulated moiré architectural mesh panel in accordance with the disclosure herein.

A portion of an architectural mesh panel in accordance with an exemplary embodiment of the disclosure is shown generally in FIG. 3 by reference numeral 100. Architectural mesh 100 preferably comprises a flat wire mesh including a plurality of spaced rods 120 disposed in succession, each rod 120 having two ends 122 and 124. Mesh 100 includes a plurality of rows of pickets 130 shown as being vertically disposed in FIG. 3 and interconnecting the succession of rods. Each row of pickets 130 is comprised of a plurality of links 140, each link 140 connecting a rod 120 with a following rod in succession.

In accordance with a first exemplary embodiment of the disclosure, pickets 130 comprise a plurality of substantially identical links 140; however, as described further below, not all the links 140 within a single picket are identical and not all the horizontally or vertically installed rows of pickets are identical.

More particularly, FIG. 3 illustrates a vertical installation of mesh 100 that is configured to present a curved surface. A contrasting background 110, such as the blue background illustrated, gives the appearance of moving stripes to an observer whose viewpoint is continuously changing from one side of the mesh towards the other.

However, since a curved installation of mesh 100 is not easily achieved or cost effective, the disclosure herein further uses the flexibility of an architectural mesh with a repeating pattern of opening sizes to achieve a moiré-like effect (simulated moiré) with only a single layer of mesh, i.e., one primary pattern, as shown by mesh panel 200, 300, 400, 500 in FIGS. 4-7. The architectural mesh panel 200, 300, 400, 500 naturally includes some depth, generally approximately 0.5", which combined with a repeating pattern of opening sizes allows the panel to achieve the moiré effect. The mesh panel 200, 300, 400, 500 can be installed on flat, angled or curved surfaces in vertical, horizontal or angular installations. It does not require heavy anchor points, is easy to install, and costs considerably less than prior systems. Mesh panel 200, 300, 400, 500 can be front and/or back lit to provide a contrasting background and thus it can also function at night. The mesh patterns, as explained in greater detail below, can be varied to provide the "appearance" of stripes, rings or circles moving across the surface of a building or an interior wall based on the observers' movement and changing viewpoint, thus creating the optical illusion of movement on the surface of the building, but with no moving components.

Figure 4:
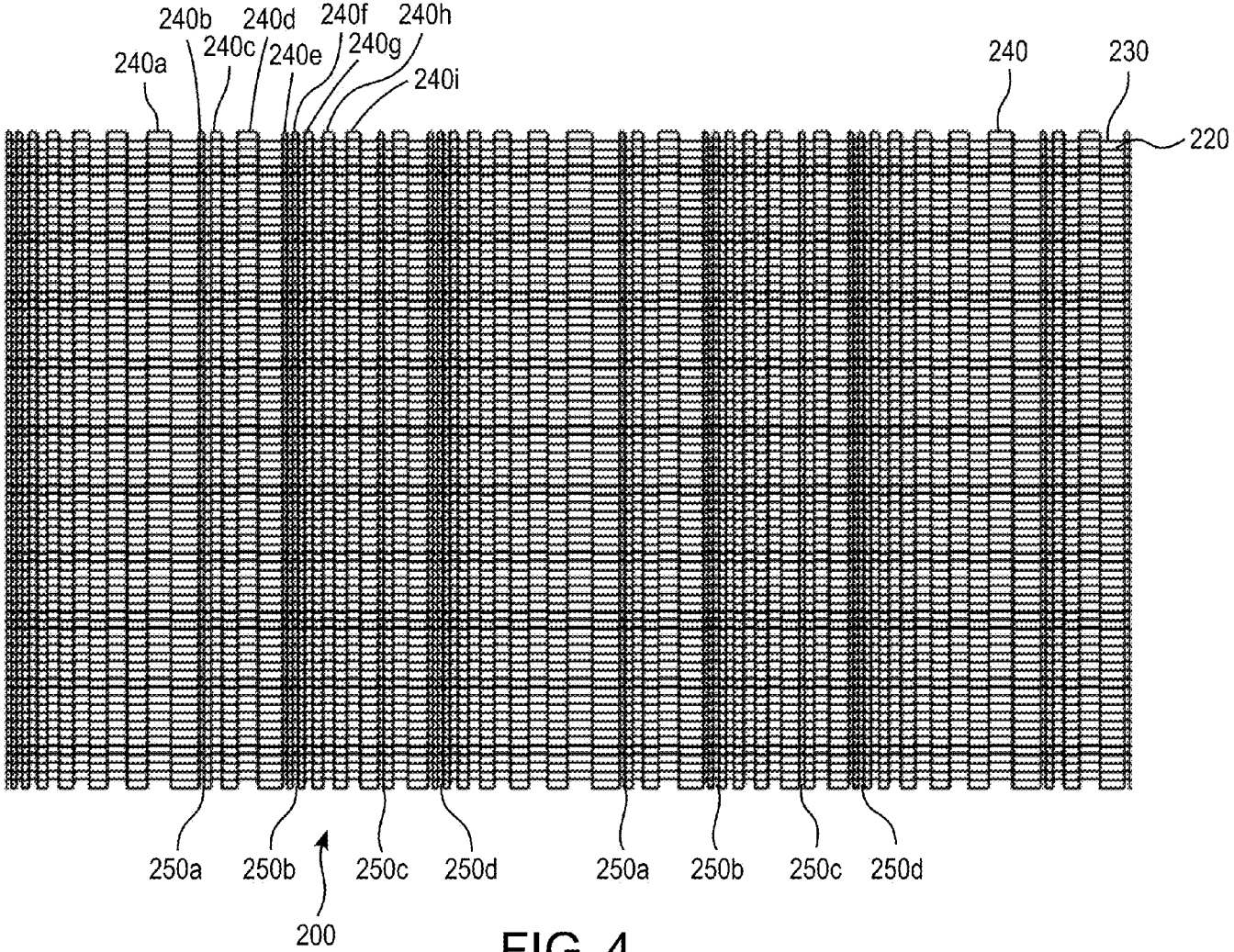
FIG. 4 is a front view of a further exemplary embodiment of a simulated moiré architectural mesh panel in accordance with the disclosure herein.

Referring to FIG. 4, mesh panel 200 discloses a horizontal installation of pickets 230 and rods 220 in a flat surface configuration. Each of the pickets 230 includes a plurality of links 240 having a varying horizontal spacing as shown for example by links 240*a* through 240*i*. That is, as the spacing decreases from link 240*a* to link 240*b* the closer links create the appearance of a vertical stripe 250*a*. The spacing then increases from link 240*c* to 240*d*, and is followed by several smaller links 240*e* and 240*f* which create the appearance of a further vertical stripe 250*b*. Links 240*g*, 240*h* and 240*i* gradually increase in width before the width of the links deceases again to create the appearance of another vertical stripe 250*c*, followed by increasing width links and then decreasing width links which create the appearance of vertical stripe 250*d*. The pattern of increasing and decreasing width links creates a repeating pattern of the vertical stripes 250*a*-250*d*. The stripes 250*a*-250*d*, also referred to as "crests", have different appearances due to the differing spacing of the links. Hence, because the spacing between the vertical stripes is not identical and the stripes are not identical, mesh 200 gives the appearance of irregular moving stripes of irregular width, i.e., crest cycloidal, to an observer whose viewpoint is continuously changing from one side of mesh 200 towards the other, as when a driver in a vehicle drives past a building onto which mesh 200 has been installed.

Figure 5:
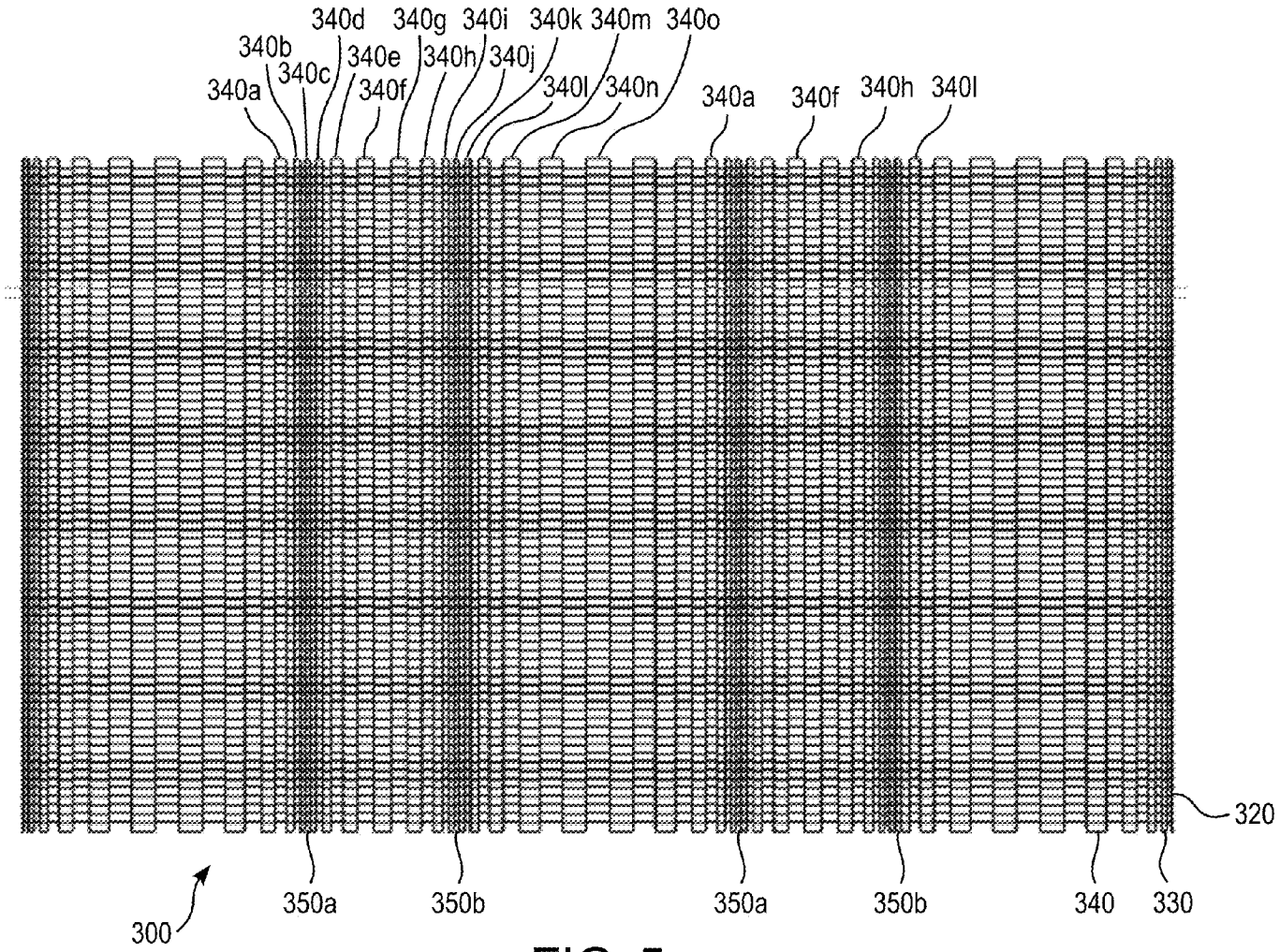
FIG. 5 is a front view of a further exemplary embodiment of a simulated moiré architectural mesh panel in accordance with the disclosure herein.

FIG. 5 illustrates a mesh panel 300 in a horizontal installation of pickets 330 and rods 320 in a flat surface configuration. Each of the pickets 330 includes a plurality of links 340 having a varying horizontal spacing as shown for example by links 340*a* through 340*o*. That is, as the spacing decreases from link 340*a* to link 340*d* the closely spaced links create the appearance of a vertical stripe 350*a*. The spacing then increases from link 340*e* to 340*g*, and is followed by decreasing width links 340*h* to 340*k* which create the appearance of a further vertical stripe 350*b*. Links 340*l*, 340*m*, 340*n* and 340*o* gradually increase in width before the width of the links deceases again to repeat the pattern beginning again with a link 340*a* and subsequent decreasing and increasing links to create the appearance of another vertical stripe 350*a*, followed by increasing width links and then decreasing width links which crease the appearance of another vertical stripe 350*b*. The pattern of increasing and decreasing width links creates a repeating pattern of the vertical stripes 350*a* and 350*b*. The stripes 350*a*, 350*b* have a similar or identical appearance due to the spacing of links 340*b*-340*e* defining stripe 350*a* being substantially identical to links 340*i*-3401 defining stripe 350*b*. Hence, because the spacing between the vertical stripes is not identical but the stripes are substantially identical, and the opening size of the links evenly increases and decreases across the width of the mesh panel, mesh 300 gives the appearance of regular moving stripes, i.e., cycloidal, to an observer whose viewpoint is continuously changing from one side of mesh 300 towards the other, as when a driver in a vehicle drives past a building onto which mesh 300 has been installed. That is, the cycle from the smallest link to the largest link, and back again, will be evenly spaced so the widest link opening is in the middle of the cycling pattern.

Figure 6:
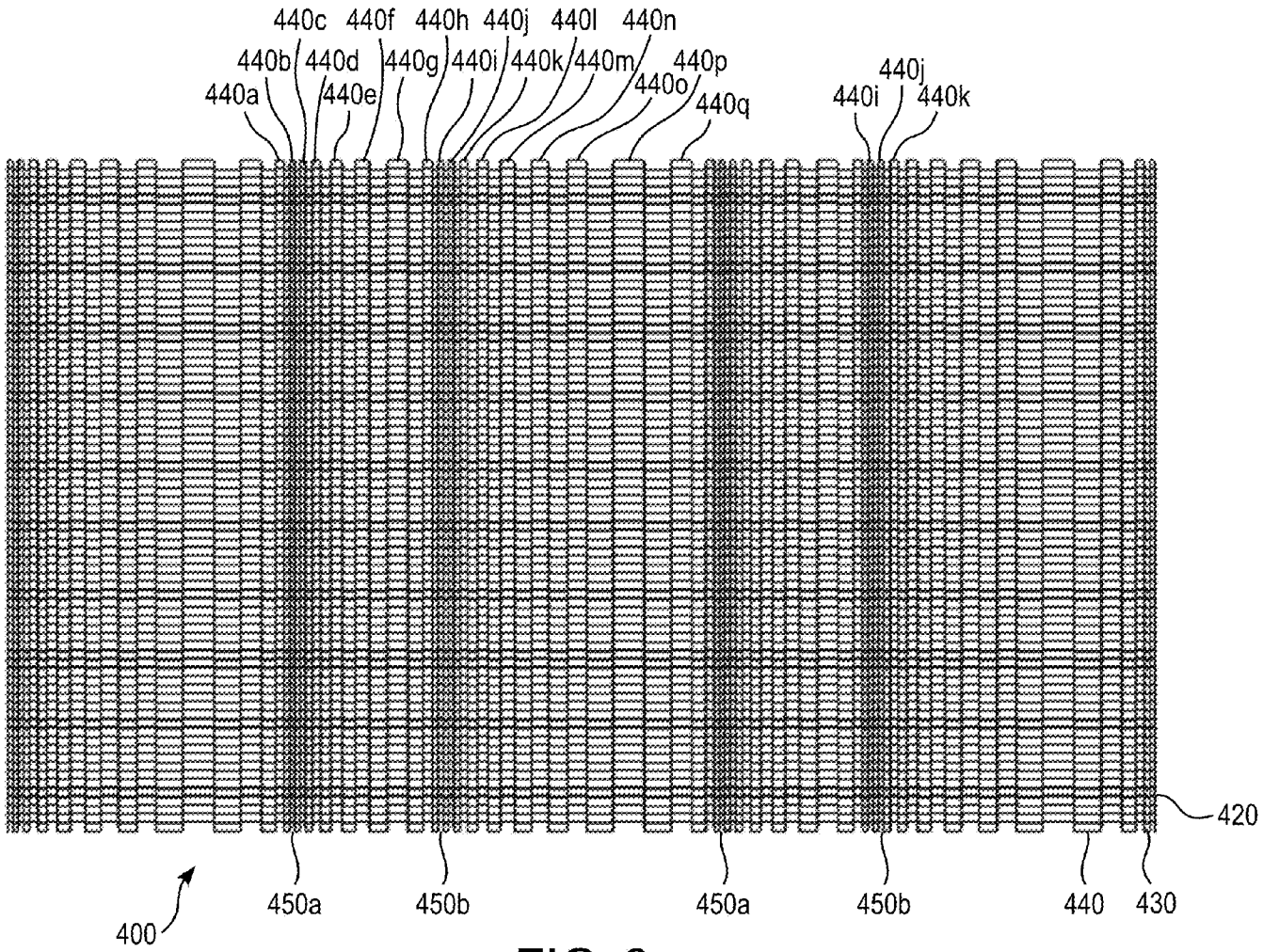
FIG. 6 is a front view of a further exemplary embodiment of a simulated moiré architectural mesh panel in accordance with the disclosure herein.

Referring to FIG. 6, mesh panel 400 discloses a horizontal installation of pickets 430 and rods 420 in a flat surface configuration. Each of the pickets 430 includes a plurality of links 440 having a varying horizontal spacing as shown for example by links 440*a* through 440*q*. That is, as the spacing decreases from link 440*a* to link 440*b*, the closer links 440*b*-440*d* create the appearance of a vertical stripe 450*a*. The spacing then increases from link 440*e* to 440*g*, and is followed by a smaller link 440*h*, and then smaller, closer links 440*i*-440*k* which create the appearance of a further vertical stripe 450*b*. Links 440*l* to 440*p* gradually increase in width before the width of the links decease again at link 440*q*, and repeat a pattern beginning with link 440*a* to create the appearance of repeating vertical stripes 450*a* and 450*b*. The stripes 450*a* and 450*b* have substantially similar appearances due to the substantially similar spacing of the links. However, because the vertical stripes and the spacing between the vertical stripes are not identical and the opening size of the links does not uniformly increase to the widest link of the mesh panel or uniformly decrease as cycling back to the narrowest link, mesh 400 gives the appearance of irregular moving stripes, i.e., offset cycloidal, to an observer whose viewpoint is continuously changing from one side of mesh 400 towards the other, as when a driver in a vehicle drives past a building onto which mesh 400 has been installed. That is, the cycle from the narrowest link to the widest link, and back again, is offset so the widest link opening is offset from the middle of the cycling pattern.

Figure 7A:
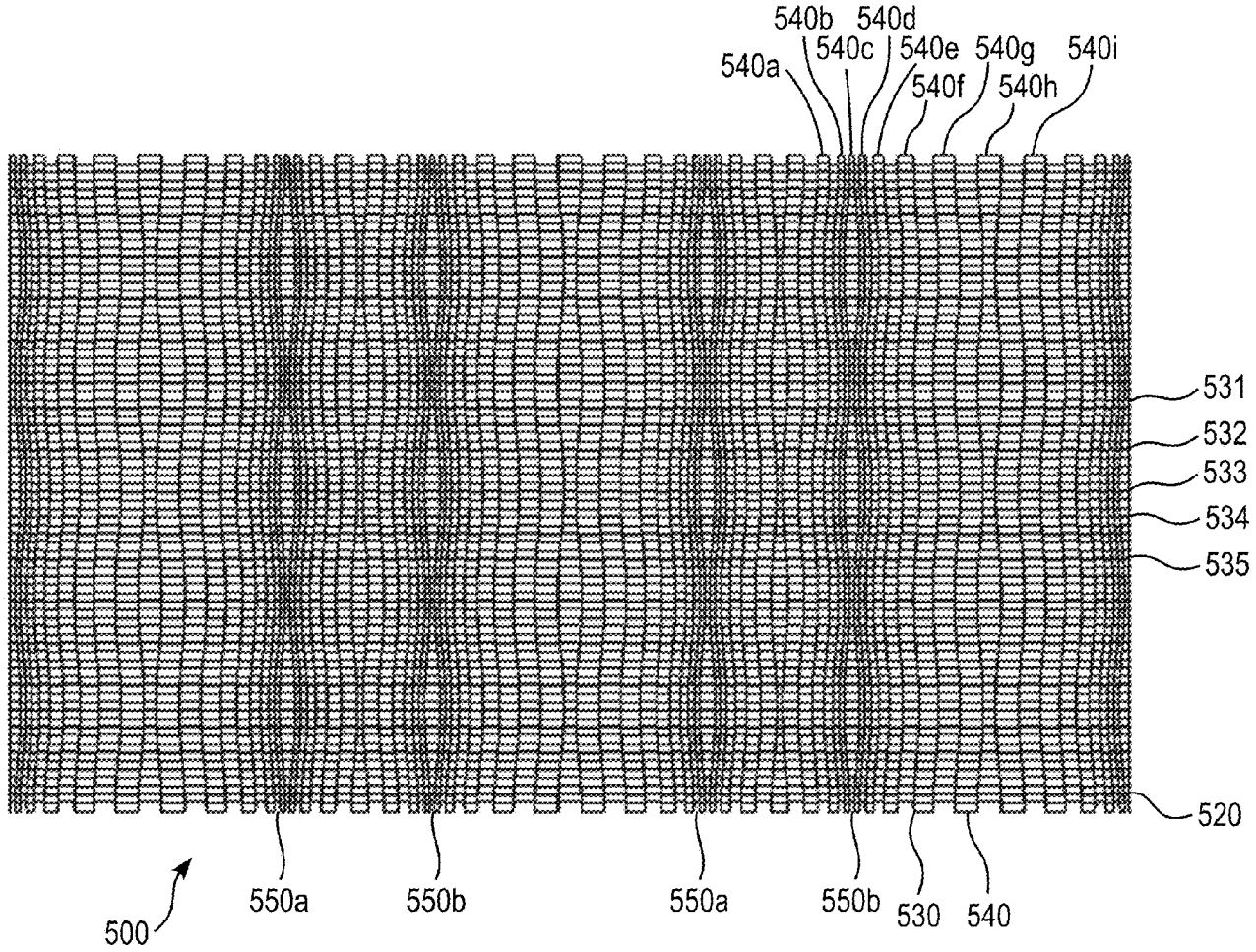
FIG. 7A is a front view of a further exemplary embodiment of a simulated moiré architectural mesh panel in accordance with the disclosure herein and FIG. 7B is a partial enlarged view thereof.
Figure 7B:
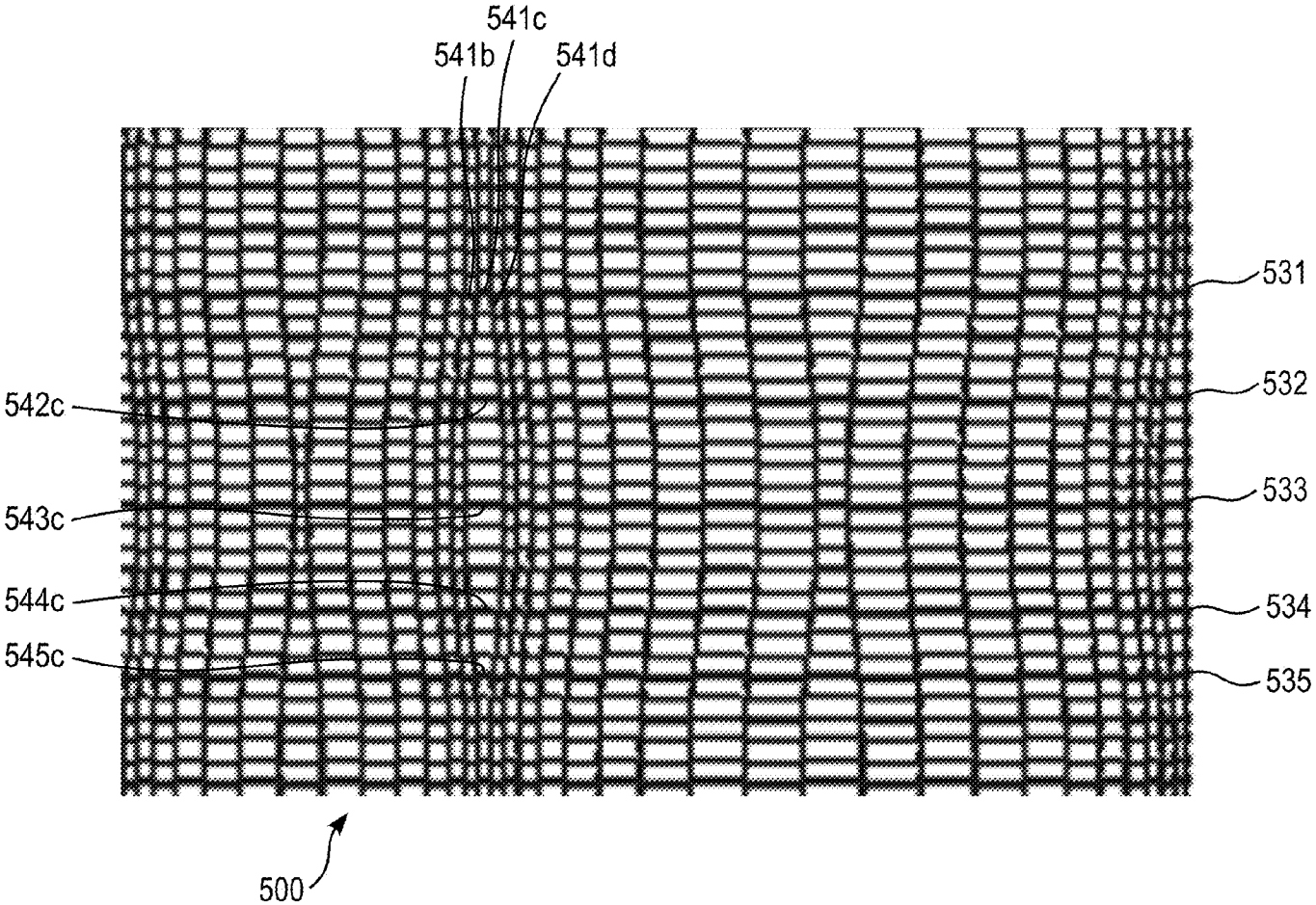

FIG. 7A illustrates a mesh panel 500 in a horizontal installation of pickets 530 and rods 520 in a flat surface configuration. Each of the pickets 530 includes a plurality of links 540 having a varying horizontal spacing, such as links 540*a*-540*i* shown on the leading edge of mesh 500. However, unlike the previous discussed embodiments, each of the pickets is not identical to an adjacent picket disposed in the transverse direction. Hence, the width opening of corresponding vertically aligned links in a first picket 531 may be different from the width opening of links in a second picket 532, which is different still from the width opening of links in a third picket 533, and so on in a repeating pattern to achieve the desired appearance in mesh 500. More particularly, as the spacing decreases from link 540*b* to link

540*d* and then increases from link 540*e* to link 540*g*, in the leading row, the closely spaced link area creates the appearance of a generally vertically disposed stripe 550*b*. However, since all the pickets 530 are not substantially identical, the stripe 550*b* is not symmetrical from the trailing edge (bottom) to the leading edge (top). As shown best by way of example in FIG. 7B, in picket 531 the width opening (spacing) of links 541*b*-541*d* is fairly close, whereas in picket 532 the width opening of link 542*c* is greater than the corresponding width opening of link 541*c* in picket 531. Still further, in picket 533 the width opening of link 543*c* is greater than that of the corresponding link in picket 532. The spacing then decreases in picket 534 for link 544*c* and decreases further in picket 535 for link 545*c*. As a result, an ellipsoidal shape is formed in mesh 500 which may be repeated along the vertical stripe 550*b* as well as in stripe 550*a*. Although only one link opening is identified, one skilled in the art will appreciate that varying the width vertically as well as horizontally can allow a variety of patterns to be formed. Hence, because the spacing between the vertical stripes 550*a*, 550*b* is not identical but the stripes are substantially identical, mesh 500 gives the appearance of irregular moving stripes including rings or circles or other ellipsoidal shapes, i.e., double cycloidal, to an observer whose viewpoint is continuously changing from one side of mesh 500 towards the other, as when a driver in a vehicle drives past a building onto which mesh 500 has been installed.

Figure 8A:
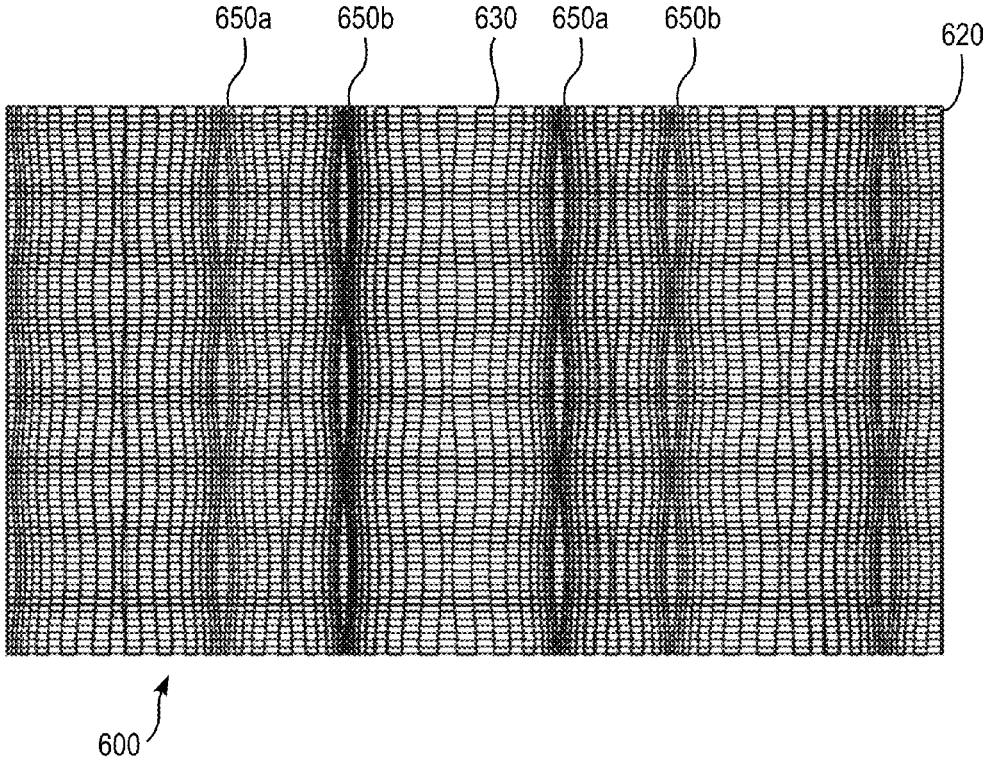
FIG. 8A is a front view of a further exemplary embodiment of a simulated moiré architectural mesh panel in accordance with the disclosure herein and FIG. 8B is a top view thereof.
Figure 8B:
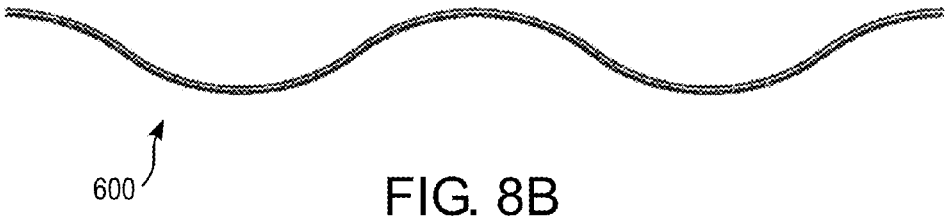
Figure 9A:
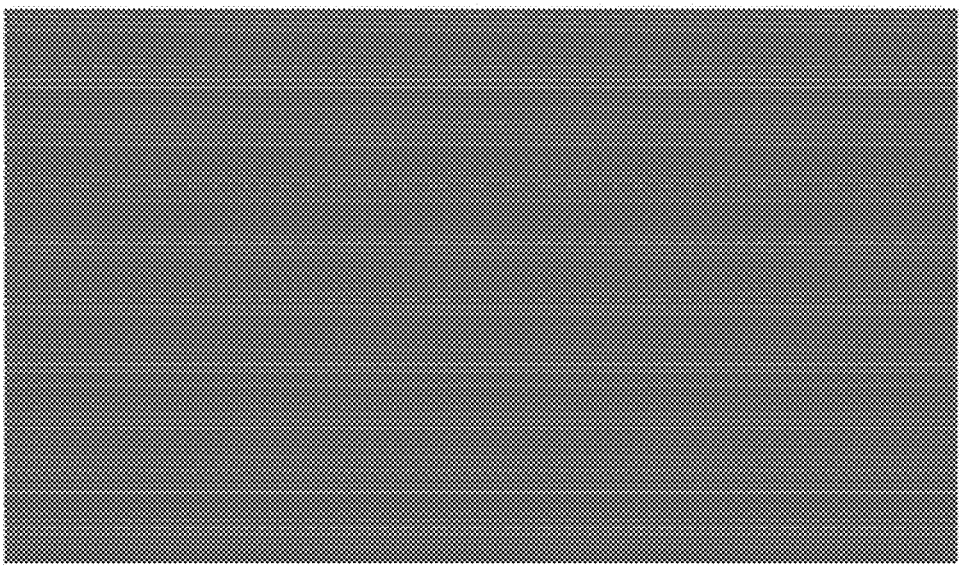
FIGS. 9A-9F illustrate a simulated moiré architectural mesh panel in accordance with the disclosure as viewed by an observer as he passes in front of the mesh at various angles.
Figure 9B:
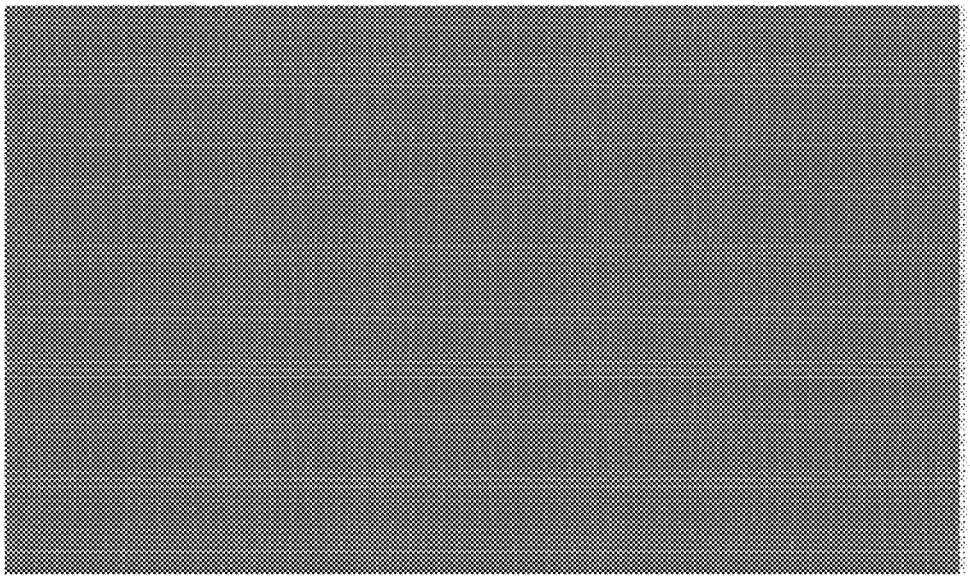
Figure 9C:
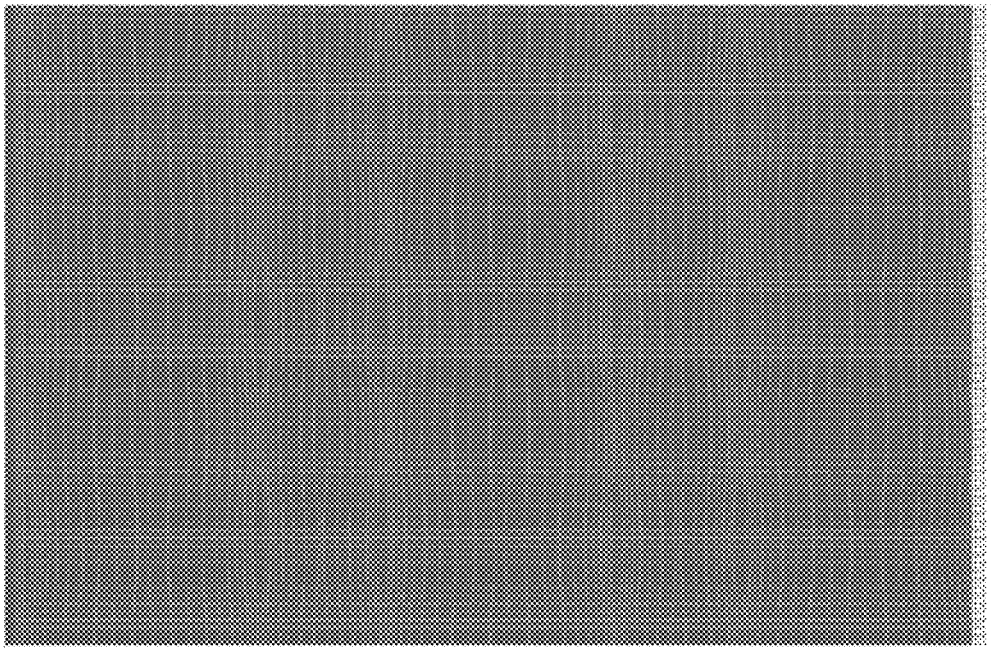
Figure 9D:
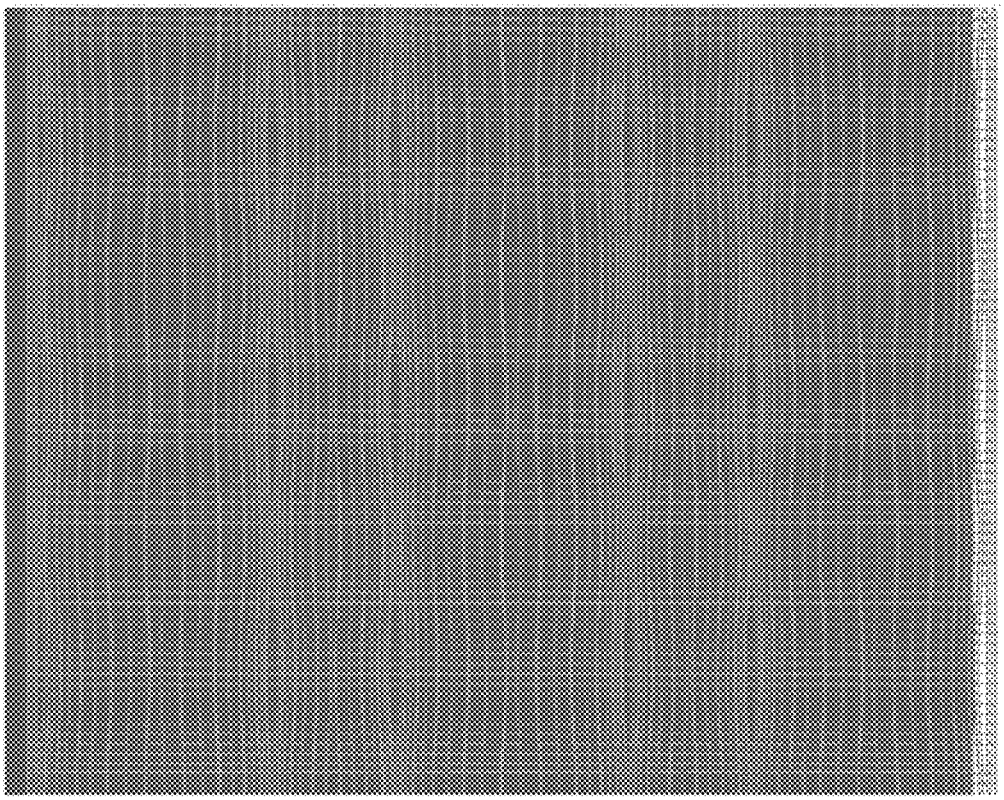
Figure 9E:
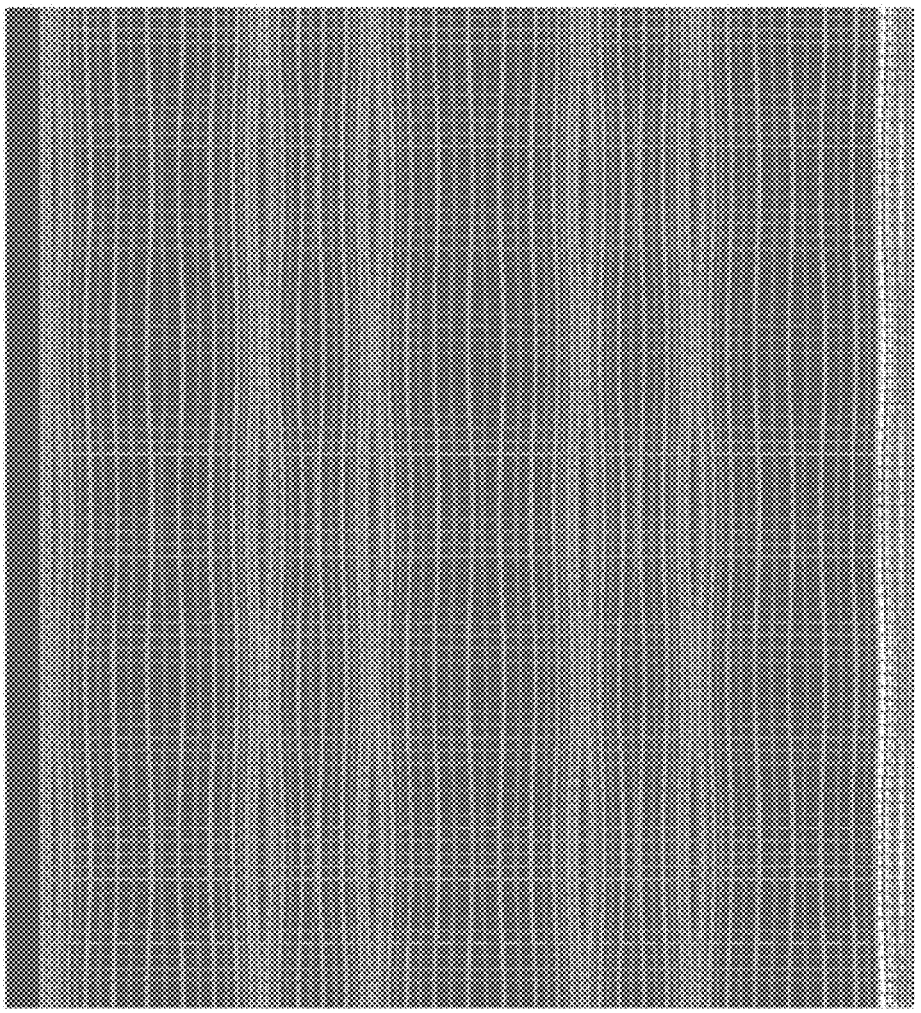
Figure 9F:
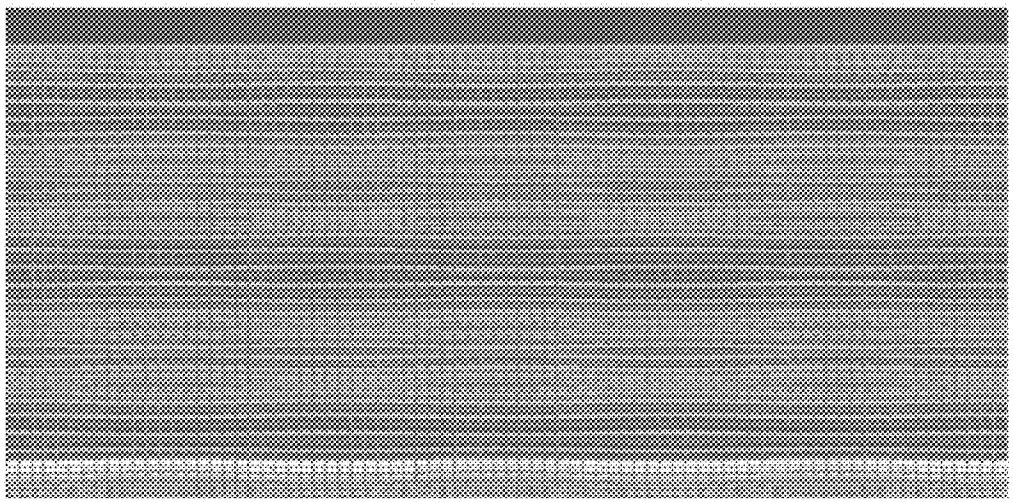

FIGS. 8A and 8B illustrate a mesh panel 600 in a horizontal installation of pickets 630 and rods 620 in a curved surface configuration. By varying a curved surface to be in phase or out of phase with the mesh spacing variations in the links, the effects can be more pronounced. Thus, while mesh 600 is substantially identical in structure to mesh 500 the use thereof in a curved installation further emphasizes the movement of the stripes 650*a*, 650*b* including rings or circles or other ellipsoidal shapes, i.e., double cycloidal, to an observer whose viewpoint is continuously changing from one side of mesh 600 towards the other, as when a driver in a vehicle drives past a building onto which mesh 600 has been installed.

FIGS. 9A-9F illustrate a moiré architectural mesh panel in accordance with the disclosure, such as double cycloidal mesh panel 500, as viewed by an observer as they pass in front of the mesh at various angles. More specifically, the viewing angle varies in FIGS. 9A to 9F from 0, 15, 30, 45, 60 and 75 degrees, respectively, and one can appreciate the variance in shape of the vertical stripes and the geometrical patterns within the stripes as the viewing angle changes.

The exemplary embodiments described above disclose symmetrical rows of vertically aligned cubist links defining vertical stripes, as well as stripes including ellipsoidal shapes and the like. One skilled in the art will recognized that the spacing between the links can be adjusted to achieve any geometrical shape desired, including but not limited circles, rings, wedges, rectangles, and the like.

In addition, the exemplary embodiments described herein disclose horizontal installations intended for wall surfaces. However, one skilled in the art will recognize the vertical installations of any described mesh is also possible, and that the mesh may also be used on ceiling surfaces.

While the disclosure herein has been described with respect to particular exemplary embodiments of the invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention as defined only by a proper interpretation of the appended claims.

The invention claimed is:

1. An architectural metal mesh panel comprising:

a plurality of spaced metal rods and a plurality of adjacent rows of metal pickets interconnecting the plurality of spaced metal rods, each of the rows of metal pickets including at least a plurality of first links, a plurality of second links and a plurality of third links, the plurality of first links have a first spacing, the plurality of second links have a second spacing, and the plurality of third links have a third spacing, wherein at least some of the metal pickets and at least some of the first links are made from the same piece of metal over at least a partial length of at least one of the metal rods, wherein the first spacing is less than the second spacing and the second spacing is less than the third spacing, wherein each of the rows of metal pickets includes at least two adjacent first links defining a primary closely spaced link area, wherein each of the rows of metal pickets includes at least one second link disposed adjacent the primary closely spaced link area on at least one side thereof, wherein the plurality of rows of metal pickets are configured to form a repeating pattern of through openings which create a simulated moiré appearance of a moving stripe to an observer whose viewpoint is continuously changing from one side of the architectural mesh panel towards the other.

2. The architectural metal mesh panel according to claim 1, wherein said plurality of adjacent rows of pickets are substantially identical.

3. The architectural metal mesh panel according to claim 1, wherein said primary closely spaced link area defines a first primary closely spaced link area, and the architectural metal mesh panel further comprises a second primary closely spaced link area creating a simulated moiré appearance of a second moving stripe to an observer whose viewpoint is continuously changing from one side of the architectural mesh panel towards the other.

4. The architectural metal mesh panel according to claim 3, wherein said first and second primary closely spaces areas form a regularly repeating pattern across a width of the architectural mesh panel.

5. The architectural metal mesh panel according to claim 3, wherein said first and second primary closely spaces areas form an irregularly repeating pattern across a width of the architectural mesh panel.

6. The architectural metal mesh according to claim 1, wherein each of the rows of pickets further includes at least one first link adjacent at least one second link on at least one side thereof defining a first secondary closely spaced link area.

7. The architectural metal mesh according to claim 6, wherein each of the rows of pickets further includes at least one first link adjacent at least one second link on at least one side thereof defining a second secondary closely spaced link area.

8. The architectural metal mesh according to claim 1, wherein each of the pickets further includes at least one second link disposed adjacent the primary closely spaced link area on each side thereof.

9. The architectural metal mesh panel according to claim 1, wherein the plurality of rows of metal pickets define a plurality of through openings.

10. The architectural metal mesh panel according to claim 9, wherein each of said plurality of through openings defines a predetermined width.

11. An architectural metal mesh panel comprising:

a plurality of metal spaced rods and a plurality of adjacent rows of metal pickets interconnecting the plurality of spaced rods, each of the rows of pickets including a plurality of links defining a plurality of through openings having a predetermined width, said plurality of rows of metal pickets including at least a first picket, a second picket and a third picket, wherein said first picket includes at least one first link having a first spacing, said second picket includes at least one first link having a second spacing and said third picket includes at least one first link having a third spacing, said first links of the first, second and third pickets being longitudinally aligned in the architectural mesh panel, wherein at least some of the metal pickets and at least some of the first links are integrally formed from the same piece of metal over at least a partial length of at least one of the metal rods, wherein the first spacing is less than the second spacing and the second spacing is greater than the third spacing such that the first links form a geometrical pattern in a longitudinal direction of the architectural mesh panel.

12. The architectural metal mesh panel according to claim 11, wherein the first picket further includes a plurality of second links, the second picket further includes a plurality of second links, and the third picket further includes a plurality of second links, said second links of the first, second and third pickets being longitudinally aligned in the architectural mesh panel, wherein the first, second and third rows of pickets include at least one second link disposed on each side of the at least one first link such that the first and second links of the first, second and third rows create a simulated moiré appearance of a moving stripe including a changing geometrical shape to an observer whose viewpoint is continuously changing from one side of the architectural mesh panel towards the other.

* * * * *